US006164617A

United States Patent [19]

Butterfield et al.

[11] Patent Number: 6,164,617

[45] Date of Patent: Dec. 26, 2000

[54] HANGER AND PIN ASSEMBLY FOR DISPLAYING MERCHANDISE

[75] Inventors: Stephen H. Butterfield, Gurnee, Ill.; Cletis F. Swopes, Madison, Wis.

[73] Assignee: Springs Window Fashions Division, Inc., Middleton, Wis.

[21] Appl. No.: 09/304,289

[22] Filed: May 3, 1999

[51] Int. Cl.[7] ..... A47G 29/00; F16M 11/00

[52] U.S. Cl. ..... 248/690; 248/317; 248/686; 248/690; 211/50; 211/59.1

[58] Field of Search ..... 248/317, 340, 248/686, 690; 211/50, 57.1, 59.1; 411/509, 510, 913

[56] References Cited

U.S. PATENT DOCUMENTS

| | | | |
|---|---|---|---|
| 2,378,665 | 6/1945 | Threeton | 206/7 |
| 2,723,816 | 11/1955 | Drysdale | 248/29 |
| 3,123,331 | 3/1964 | Field et al. | 248/317 |
| 3,302,917 | 2/1967 | Winkler | 248/317 |
| 4,266,677 | 5/1981 | Dewsnap | 211/45 |
| 4,728,238 | 3/1988 | Chisholm et al. | 411/510 |
| 5,014,957 | 5/1991 | Nichol, Jr. | 248/340 |
| 5,813,549 | 9/1998 | Sheehan et al. | 211/59.1 X |

*Primary Examiner*—Leslie A. Braun
*Assistant Examiner*—A. Joseph Wujciak
*Attorney, Agent, or Firm*—Lerner, David, Littenberg, Krumholz & Mentlik, LLP

[57] ABSTRACT

An improved hanger and pin assembly for holding, hanging and displaying merchandise, such as a plurality of louvers for window blinds, at the point of sale for such merchandise having, a generally planar member, a pin member disposed for operative engagement with one end of the planar member for removably connecting the plurality of elements of the merchandise to the hanger and pin assembly to form a modular unit, an annular section on the planar member defining a sized opening at the opposite end of the planar member for removably mounting the plurality of elements at the point of sale for such merchandise, and spaced protuberances medially disposed on the planar member between the annular section defining the sized opening for mounting the modular unit and the pin member, for engagement with and to stabilize the plurality of elements in assembled position. An alternate form of the hanger section of the hanger and pin assembly has an arcuate section for defining a generally sized opening and a passage or side opening adjacent the arcuate section disposed in communication with the sized opening so formed in the planar member.

15 Claims, 3 Drawing Sheets

HANGER AND PIN ASSEMBLY FOR DISPLAYING MERCHANDISE

FIELD OF THE INVENTION

This invention relates generally to the promotion and merchandising of a product for sale to the public and more particularly to a hanger and pin assembly for displaying modular units of the elements of such merchandise such as louvers or slats for window blinds of the same size, shape, color and design to enable customers at the point of sale for such merchandise to select the required quantity of modular units for a given size window or opening in which a window blind is to be mounted.

BACKGROUND OF THE INVENTION

Although the present invention will be illustrated with respect to modular units of louvers and slats for window blinds, this is not by way of limitation, because the present invention is equally applicable to displays of modular units of elements for any type and size of product to be displayed for sale.

Thus, in today's modern world, decorators as well as the do-it-yourselfers seek to modify and improve the decor of a home and look for relatively simple ways to accomplish this accepted and desirable practice.

The present invention illustrates one means for displaying products and merchandise to aid such customers to enable them to create, improve or repair various types of window blinds by setting up the louvers or slats in assemblies or modular units with a hanger and pin assembly so they can be hung at the point of sale and thus easily examined and selected in the right multiples for the creation, improvement or repair of a given set of window blinds.

Louvers as used herein shall mean the plurality of inter-engaging slats used in horizontally or vertically mounted window blinds for controlling the light and ventilation entering through a window or opening as well as the size of the opening. Such blinds use various devices for controlling and regulating the up and down or left and right movement and inter-engagement of the louvers or slats to achieve these results, such as a cord and pulley mechanism, or a wand and carriage assembly. Louvers, their controls and regulators, their slats and other elements are well known and available on the open market and accordingly will not be more fully described because they do not form part of the present invention.

SUMMARY AND OBJECTS OF THE INVENTION

Thus, the present invention covers an improved hanger and pin assembly for holding, hanging and displaying merchandise, such as a plurality of louvers for window blinds, at the point of sale having, a generally planar member, means on the planar member for removably connecting the hanger and pin assembly to the plurality of elements of the merchandise being displayed, means on the planar member for mounting or hanging the plurality of joined elements at the point of sale for the merchandise, and means medially disposed on said planar member for engagement with and for stabilizing the plurality of elements of the merchandise in assembled position.

Accordingly, it is one aspect of the present invention to provide an improved hanger and pin assembly having means for removably connecting the hanger and pin assembly to modular units of a plurality of elements of merchandise such as louvers of the same size, shape, color and length for horizontal or vertical window blinds for windows and other openings.

It is another aspect of the present invention to provide an improved hanger and pin assembly for modular units of a plurality of elements of merchandise such as louvers of the same size, shape, color and length for horizontal and vertical window blinds having means thereon for hanging such modules at the point of sale for such modular units of such merchandise.

It is another aspect of the present invention to provide an improved hanger and pin assembly for modular units of merchandise having means thereon to steady the merchandise when it is in assembled position.

The foregoing and other objects, features and advantages of the present invention will be better understood and become apparent from the following description of a preferred embodiment of said invention, taken in conjunction with the illustrated form of such embodiment as shown in the accompanying drawings, in which:

BRIEF DESCRIPTION OF THE DRAWINGS

FIG. 11 is a head end view of the pin member shown in FIG. 11.

DETAILED DESCRIPTION OF A PREFERRED EMBODIMENT

Figure 2:
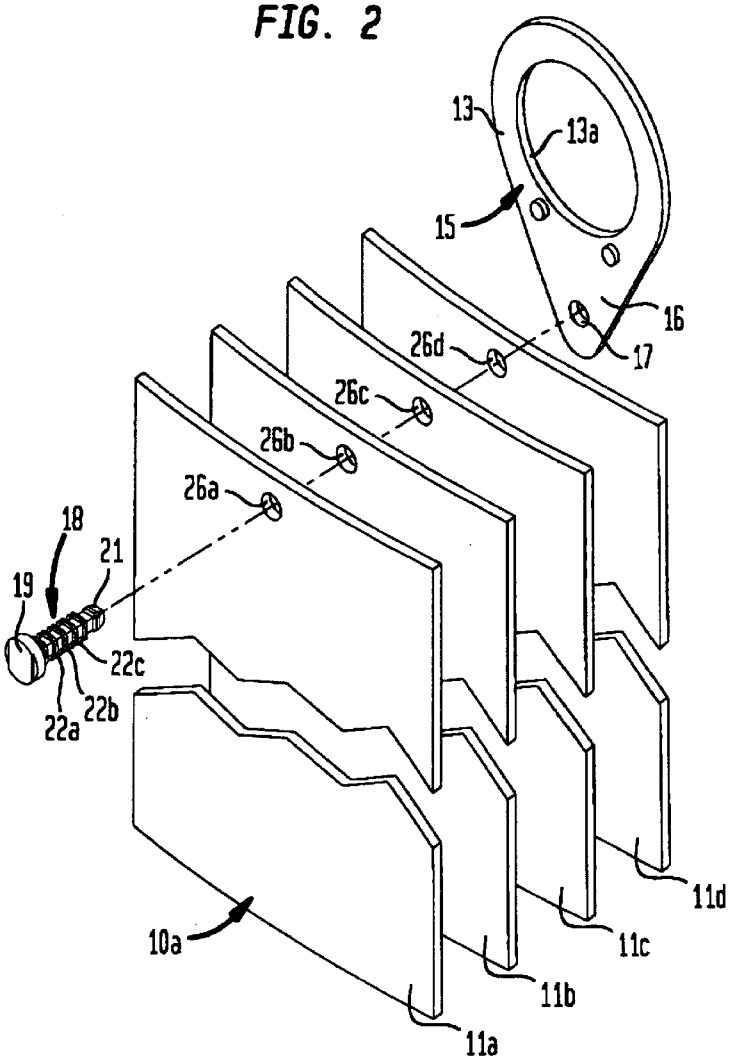
FIG. 2 is an enlarged exploded perspective view of one of the modular units in FIG. 1 showing the hanger and pin assembly in accordance with the present invention.
Figure 1:
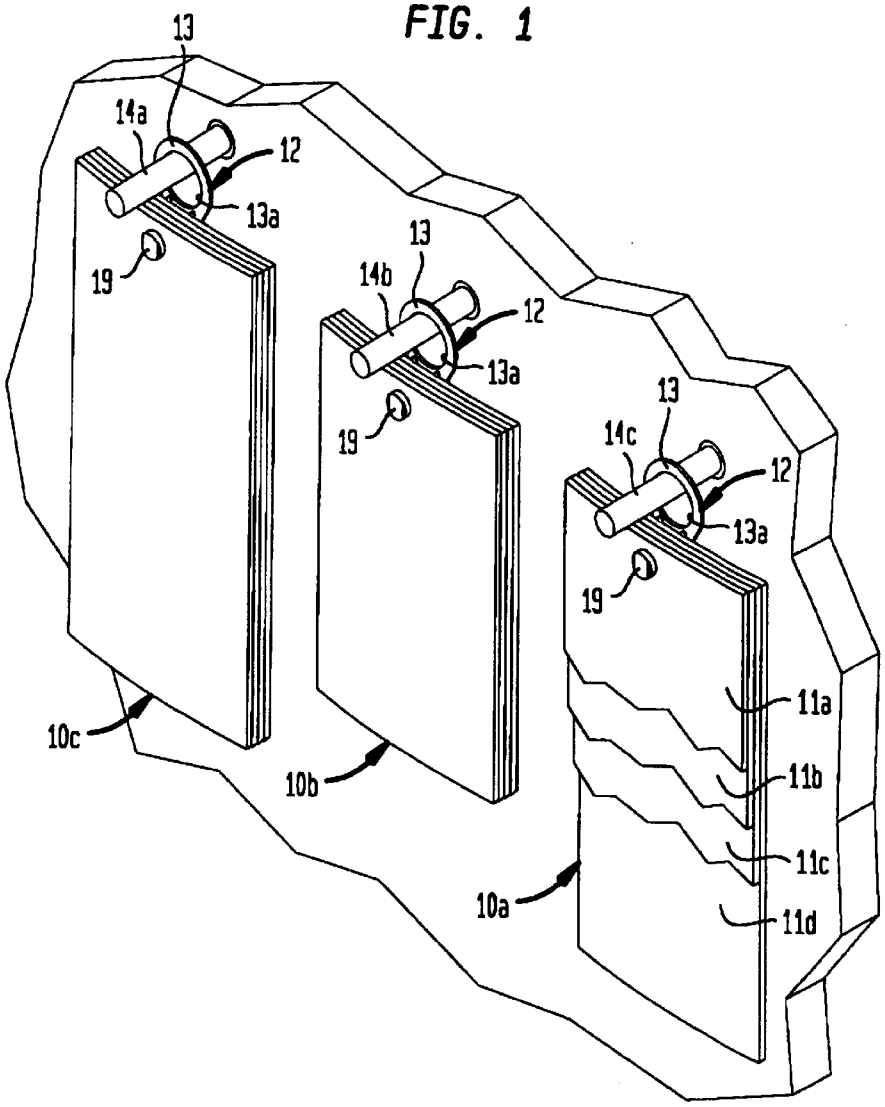
FIG. 1 is a perspective view of a plurality of modular units of vertical type louvers as displayed at the point of sale by means of the hanger and pin assemblies in accordance with the present invention.
Figure 3:
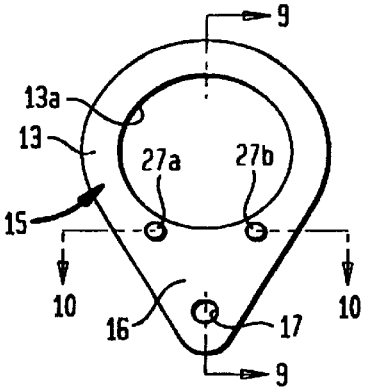
FIG. 3 is an enlarged front view of just the hanger section of the hanger and pin assembly shown in FIGS. 1 and 2.
Figure 4:
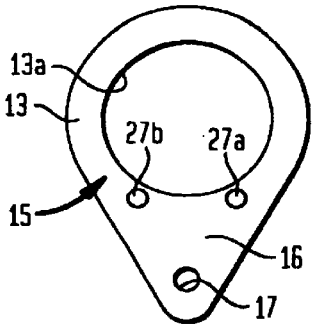
FIG. 4 is an enlarged back view of the hanger section of the hanger assembly shown in FIG. 3.
Figure 5:
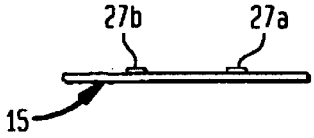
FIG. 5 is a top view of the hanger section of the hanger and pin assembly shown in FIG. 3.
Figure 6:
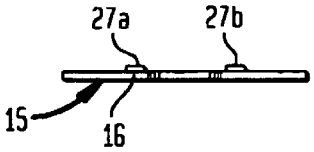
FIG. 6 is a bottom view of the hanger section of the hanger and pin assembly shown in FIG. 3.
Figure 7:
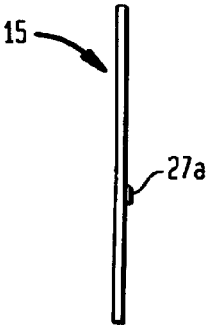
FIG. 7 is a right side view of the hanger section of the hanger and pin assembly shown in FIG. 3.
Figure 8:
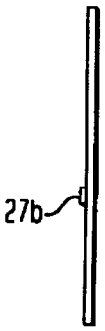
FIG. 8 is a left side view of the hanger section of the hanger and pin assembly shown in FIG. 3.
Figure 9:
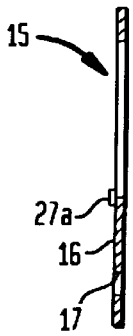
FIG. 9 is a vertical cross-section taken on line 9—9 of FIG. 3.
Figure 10:
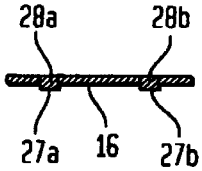
FIG. 10 is a horizontal cross-section taken on line 10—10 of FIG. 3.

Referring to the drawings, FIG. 1 shows several modular units for window blind products generally designated 10*a*, 10*b* and 10*c*. Each of these modular units has a multiplicity of various sized, shaped and lengths of louvers as, for example, 11*a*, 11*b*, 11*c* and 11*d* for modular unit 10*a* as shown in FIGS. 1 and 2. All of the louvers are connected together to form the modular unit, for example, modular unit 10*a*, by a hanger and pin assembly 12 in accordance with the present invention. The hanger and pin assemblies 12 on the modular units 10*a*, 10*b* and 10*c* are provided with suitable annular means 13 which defines an opening 13*a* to enable the modular units to be hung on suitable associated display pegs or hooks as at 14*a*, 14*b* and 14*c* disposed at the point of sale, to both display this merchandise and to make it readily and easily accessible to the customer for evaluation and purchase in connection with replacing, improving and for creating new or variations of window blinds.

The modular units 10*a*, 10*b* and 10*c*, as illustrated for modular unit 10*a* at FIG. 2, each consist of a plurality of louvers. These louvers will be generally of the same style, length, width color, shape and surface configuration or variations thereof. While one modular unit is illustrated for each of the given pegs or hooks 14*a*, 14*b* and 14*c*, those skilled in the art will recognize that the pegs and hooks can be increased in numbers or can be extended so that the number and type of modular units can be increased and/or diversified for a given display as may be required to accommodate and meet the needs as may be determined from customer interest.

Hanger section 15 of the respective hanger and pin assemblies 12 for accomplishing the display of these modular units can be made of any suitable materials such as metal or reinforced plastic. They can also have any suitable size and shape depending on the elements of the particular merchandise to be displayed. Hanger section 15 of the hanger and pin assembly 12 illustrated is made of a more or less sized thickness of sheet metal and can be easily manufactured by conventional stamping or other simple form of fabrication to produce many such sections for the hanger and pin assemblies 12 such as those in the shape and size as shown in the FIGURES of the drawings.

Thus, each of the stamped or formed hanger sections 15 of the hanger and pin assembly 12 is a generally planar member having an enlarged annular section 13 which defines the sized opening 13*a* formed therein, at one end, during fabrication of the hanger sections. Hanger section 15 is tapered towards the opposite end as at 16. The opening 13*a* in this embodiment of the invention is sized to fit on the respective pegs or hooks 14*a*, 14*b* and 14*c* as shown in FIG. 1 of the drawings. In the tapered end 16, bore 17 is provided for mounting therethrough sized and adjustable pin member 18 for connecting the elements of the merchandise to be displayed such as the louvers 11*a*, 11*b*, 11*c* and 11*d* of modular unit boa, all of which is shown in FIGS. 1 and 2 of the drawings.

Pin member 18 of the hanger and pin assembly 12 has an enlarged head 19 and an elongated shank 20 connected at one end to the enlarged head 19 and extending normal therefrom in the centerline of the pin member 18. The end 21 of the shank 20 remote from the end connected to the enlarged head 19 is slightly reduced to facilitate assembly of the elements of the merchandise onto the hanger and pin assembly 12. A space 20*a* is formed on the shank 20 between the enlarged head 19 and a plurality of serially disposed releasable locking members as at 22*a*, 22*b* and 22*c* disposed about the shank 20.

Pin member 18 of the hanger and pin assembly 12 is made of a highly resilient material such as Nylons, reinforced NYLON®, polyvinyl chloride or polyethylene which will retain its shape but is flexible or sufficiently elastic to enable the serially disposed locking members 22*a*, 22*b* and 22*c* on the pin member 18 to deflect when sufficient force is exerted during assembly and/or disassembly of the elements of the merchandise being displayed such as the louvers 11*a*, 11*b*, 11*c* and 11*d* of modular unit 10*a* when the modular units of merchandise such as the window blinds are being assembled onto or disassembled from the hanger and pin assembly 12.

Figure 11:
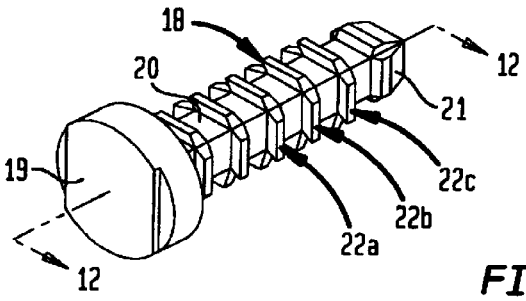
FIG. 11 is an enlarged perspective view of the pin member of the hanger and pin assembly shown in FIGS. 1 and 2.
Figure 11A:
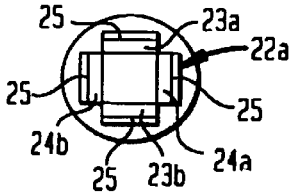
FIG. 11B is an insert end view opposite from the head end view of the pin member shown in FIG. 11.
Figure 11B:
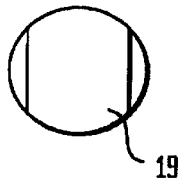
Figure 12:
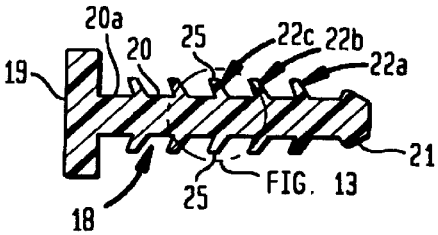
FIG. 12 is cross-section taken on line 12—12 of FIG. 11.
Figure 13:
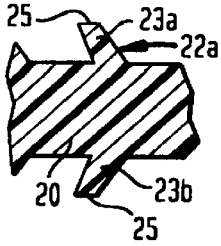
FIG. 13 is an enlarged fragmentary cross-section of one of the locking members shown in FIGS. 11 and 12.
Figure 14:
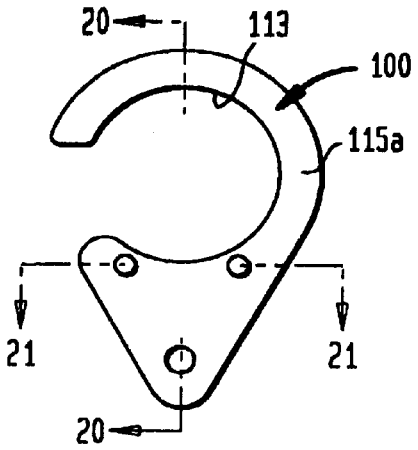
FIG. 14 is an enlarged front view of another embodiment of just the hanger section of the hanger and pin assembly in accordance with the present invention.
Figure 15:
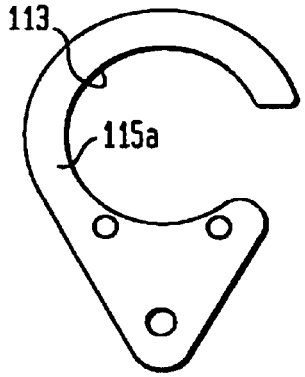
FIG. 15 is a back view of the enlarged hanger section as shown in FIG. 14.
Figure 16:
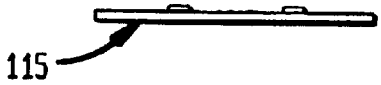
FIG. 16 is a top view of the enlarged hanger section as shown in FIG. 14.
Figure 17:
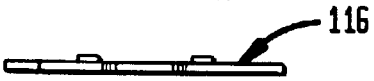
FIG. 17 is a bottom view of the enlarged hanger section as shown in FIG. 14.
Figure 18:
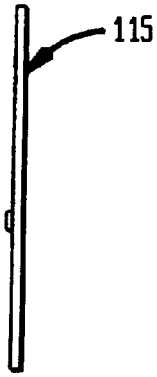
FIG. 18 is a right side view of the enlarged hanger section as shown in FIG. 14.
Figure 19:
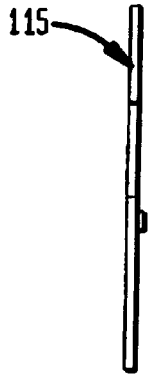
FIG. 19 is a left side view of the enlarged anger section as shown in FIG. 14.
Figure 20:
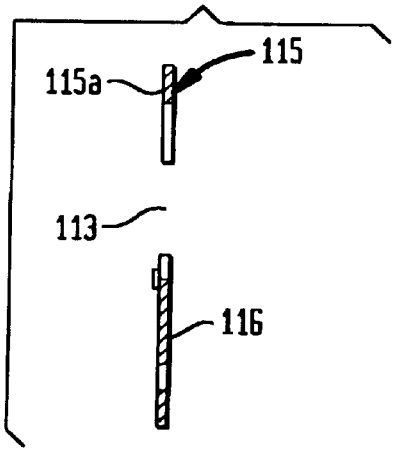
FIG. 20 is a cross-section taken on line 20—20 of FIG. 14.
Figure 21:
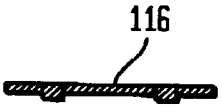
FIG. 21 is a cross-section taken on line 21—21 of FIG. 14.

Each of the releasable locking members 22*a*, 22*b* and 22*c* include, a plurality of circumferentially disposed separated and spaced upper and lower shaped locking sections 23*a* and 23*b* and separate and spaced right side and left side shaped locking sections 24*a* and 24*b*. These upper and lower locking sections 23*a* and 23*b* and right side and left side locking sections 24*a* and 24*b* all extend and face in a direction towards the enlarged head 19. Further, locking sections 23*a*, 23*b*, 24*a* and 24*b* are tapered at the ends 25 remote from the end connected to shank 20 of the pin member, and because they are also made of the same relatively flexible material from which the pin member 18 is made, even though larger in diameter than the diameter of the bore 17 and aligned bores 26*a*, 26*b*, 26*c* and 26*d* in the respective elements 11*a*, 11*b*, 11*c* and 11*d*, will readily pass through these bore and openings and can be used to compress the elements to form a compact modular unit such as the modular units 10*a*, 10*b* and 10*c* as shown in FIG. 1, and all of which is also shown in FIGS. 11 to 13 of the drawings.

The reason that the pin member 19 needs to be resilient, the reduced section 21 provided on the shank 20 of the pin member 18, the shape of the serially disposed locking members 22*a*, 22*b* and 22*c* on the pin member, the direction that the edges 25 of the locking members 23*a*, 23*b*, 24*a* and 24*b* face towards the enlarged head 19, and why the serially disposed locking members are spaced from the enlarged head 19 will be better understood from the description below concerning the assembly of the elements such as the louvers 11*a*, 11*b*, 11*c* and 11*d* of modular unit boa, onto the hanger and pin assembly 12.

Medially between the opening 13 and the bore 17 on the tapered end 16 of the hanger section of the hanger and pin assembly 12, are at least two or more protuberances as at 27*a* and 27*b* respectively disposed on opposite sides of the centerline of the hanger and pin assembly 12 formed by the sized heads of rivets 28*a* and 28*b* affixed in the conventional manner for setting rivets into assembled position on a sheet metal or other material of which the hanger section 15 is made. The protuberances may also be formed on the hanger section 15 by other techniques such as reverse indentation of the sheet metal during the fabrication of hanger section 15, as will be understood by those skilled in the art.

Assembly of a Modular Unit of Merchandise

Connecting the hanger and pin assembly 12 to the elements of the merchandise to be displayed will be illustrated with respect to the modular unit 10*a* for window blinds as shown in the FIGURES of the drawings.

Thus, elements, such as louvers 11*a*, 11*b*, 11*c* and 11*d*, are first selected and the connecting bores 26*a*, 26*b*, 26*c* and 26*d* aligned with each other so the elements will stay in general alignment when hung in the display as shown in FIG. 1. A blank hanger section 15 and an associated pin member 18 are next selected as a function of the size, width, length and other characteristics of the given elements or louvers that need to be taken into account to provide a suitable hanger and pin assembly 12 for forming and displaying the modular unit.

Holding the matched set of louvers 11*a*, 11*b*, 11*c* and 11*d* so that the connecting bores 26*a*, 26*b*, 26*c* and 26*d* are in alignment with each other, the pin member 18 is press fitted through the connecting bores 26*a*, 26*b*, 26*c* and 26*d* from the front end of the aligned louvers until the enlarged head 19 rests on the front surface of the first of the matched louvers and at least one or more of the locking sections 23*a*, 23*b*, 24*a* and 24*b* of the releasable locking members 22*a*, 22*b* and 22*c* clear the back surface of the last of the matched louvers so that at least a portion of the matched set of louvers rest in the space 20*a* on the pin member 18 between the enlarged head 19 and the serially disposed releasable locking members.

It is noted that the tapered edges 25 on the locking sections 23*a*, 23*b*, 24*a* and 24*b* of the releasable locking members 22*a*, 22*b* and 22*c* face towards the enlarged head 19 on the pin member 15. Therefore, the shank 20 having the releasable locking members serially disposed thereon can be forced and press fitted through the connecting bores 26*a*, 26*b*, 26*c* and 26*d* because the releasable locking members are sufficiently flexible or elastic to enable them to squeeze through these connecting bores even though these bores are of a lesser diameter than the diameter of the locking sections 23*a*, 23*b*, 24*a* and 24*b* on the respective releasable locking members 22*a*, 22*b* and 22*c*.

When the shank 20 of the pin member 18 has been press fitted through the connecting bores 26*a*, 26*b*, 26*c* and 26*d* as above described, the tapered end 21 of the shank 20 on the pin member 18 can in the same manner be forced through the bore 17 in the tapered end 16 of the hanger section 15. Then, the hanger section 15 is pressed into firm engagement with the back surface of the last louver 11*d* to snugly hold the set of assembled louvers, all of which is shown in FIGS. 1 and 2 of the drawings.

Thus, in the above example, the assembly of the modular unit 10*a* of a set of matched louvers is established with the improved hanger and pin assembly 12 which enables the modular unit to be easily displayed on the pegs or hooks 14 at the point of sale, as is shown in FIG. 1.

Description of Another Embodiment

FIGS. 4 to 21 show another embodiment of the hanger section 115 for the hanger and pin assembly in accordance with the present invention.

In this embodiment, the hanger section 115 is also a generally planar member made of a sized thickness of sheet metal or reinforced plastic having any suitable size and shape dependent on the elements of the particular product to be displayed. Hanger section 115 has a wide annular end as at 115*a* in which a sized opening 113 is formed during fabrication of the hanger section. This embodiment of the hanger section has the same shape and size as the hanger section 15 first above shown and described and accordingly forms a tapered end 116 at the end opposite from the wide end 115*a* defining the opening 113. As in the first embodiment above described, the opening 113 is sized to fit on an elongated suit or dress type support bar, not shown, instead of pegs or hooks 14*a*, 14*b* and 14*c* in the manner shown for hanger section 15, in FIG. 1 of the drawings.

Hanger section 115 further differs from the form of the hanger section 15 in that there is a passage, side opening or space formed at 113*a* for the wide annular end 115*a* which communicates with the sized opening 113 to facilitate mounting and removal of a modular unit from an elongated support bar or rod, not shown, at the display site, when the modular unit is formed with a hanger and pin assembly having a hanger section in accordance with this embodiment of the invention.

Hanger section 115 is otherwise identical to hanger section 15 and accordingly will relate in the same manner to the pin member 18, the enlarged protuberances 24*a* and 24*b* and the assembly, all as above described for the form of the invention shown and described at FIGS. 1 to 13 of the drawings.

Thus, an improved device for displaying products has been shown and described which is simple, relatively low in cost and provides easy accessibility for the customer.

It will be understood that the invention is not to be limited to the specific construction or arrangement as shown and that changes and modifications may be made without departing from the spirit and scope of invention as defined by the appended claims.

What is claimed is:

1. A hanger and pin assembly for displaying merchandise comprising:

a. a planar member having means for connecting the hanger and pin assembly to the merchandise to be displayed, b. means on the planar member spaced from the connecting means for mounting the merchandise at the point where it will be displayed, and c. means on the planar member being formed of at least one proturberance between said mounting means and said connecting means for steadying the merchandise when it is in assembled position on the hanger and pin assembly.

2. The hanger and pin assembly in claim 1 wherein said connecting means includes, a pin member having, a head end, and an elongated shank member connected to said head end disposed to extend through the merchandise to be displayed and to engage the planar member, and releasable locking means on the shank member to hold the assembled merchandise being displayed.

3. A hanger and pin assembly as in claim 2 wherein the pin member is made of a resilient material.

4. A hanger and pin assembly as in claim 2 wherein the pin member is made from a resilient plastic member.

5. A hanger and pin assembly as in claim 3 wherein the resilient plastic material is a polyvinyl chloride.

6. A hanger and pin assembly as in claim 2 wherein the releasable locking means on the shank member is made from a flexible and resilient material.

7. A hanger and pin assembly as in claim 2 wherein the releasable locking means on the shank member is made from a flexible and resilient material.

8. The hanger and pin assembly in claim 7 wherein the planar member has a front face and a rear face, and the protuberance means includes at least two enlargements formed on at least said front face of the planar member.

9. The hanger and pin assembly in claim 1 wherein the mounting means on the planar member includes an annular section defining a sized opening therethrough.

10. The hanger and pin assembly in claim 1 wherein the mounting means on the planar member includes an annular section defining, a sized opening therethrough, and a passage in at least one side of said annular section of the planar member disposed for communication with the sized opening.

11. The hanger and pin assembly in claim 1 or 2 wherein the means for steadying the merchandise includes, protuberance means on the planar member.

12. The hanger and pin assembly as in claim 1, having a hanger section and an associated pin member wherein the hanger section is stamped from sheet metal.

13. A hanger and pin assembly for displaying merchandise comprising:

a. a planar member having, hanger section means, b. pin means operatively associated with the hanger section for connecting the hanger and pin assembly to the merchandise to be displayed, c. said pin means having a head end, an elongated shank member connected to said head end and disposed to extend through the merchandise and to engage the planar member, and releasable locking means on the shank member to hold the merchandise being displayed, d. mounting means on the hanger section spaced from the pin means for mounting the assembled merchandise at the point where it will be displayed, and e. spaced protuberances on the planar member between the mounting means and the connecting means for engagement with the merchandise connected to the hanger and pin assembly to steady the same in assembled position.

14. The hanger and pin assembly in claim 13 including, protuberance means on the planar member between connecting means and the annular section defining the opening for mounting the modular units, to steady the modular unit when it is so mounted.

15. A hanger and pin assembly for a modular unit of matched pieces of merchandise to be mounted on a display means at the point of sale for such merchandise comprising:

a. a sized and shaped generally planar member having, a hanger section, means at one end of the hanger section for connecting said hanger and pin assembly to said modular unit of matched pieces of merchandise, and an opening on said hanger section a spaced distance from said connecting means for removably mounting the modular unit on said display means, b. said connecting means including, a bore in said hanger section, an elongated member having, a head at one end for engagement with said modular unit to act as a stop shoulder in assembled position, a shank disposed to extend from the head end of the elongated member for engagement with the matched pieces of merchandise in the modular unit, and the bore to force the hanger section into engagement with the matched pieces of the modular unit, and said shank having releasable locking means for removably holding the matched pieces of the modular unit on the hanger and pin assembly.

* * * * *

UNITED STATES PATENT AND TRADEMARK OFFICE

CERTIFICATE OF CORRECTION

PATENT NO. : 6,164,617
DATED : December 26, 2000
INVENTOR(S) : Butterfield et al.

It is certified that error appears in the above-identified patent and that said Letters Patent is hereby corrected as shown below:

Column 2,
Line 51, "11" should read -- 11A --.

Column 3,
Line 3, "anger" should read -- hanger --.
Line 64, "boa" should read -- 10a --.

Column 4,
Line 11, "Nylons" should read -- Nylon® --.
Line 49, "boa" should read -- 10a --.

Column 6,
Line 47, "claim 3" should read -- claims 3 or 4 --.

Signed and Sealed this

Twenty-fifth Day of December, 2001

*Attest:*

*Attesting Officer*

JAMES E. ROGAN
*Director of the United States Patent and Trademark Office*